United States Patent [19]

Matsudaira et al.

[11] Patent Number: 4,734,618

[45] Date of Patent: Mar. 29, 1988

[54] ELECTROLUMINESCENT PANEL COMPRISING A LAYER OF SILICON BETWEEN A TRANSPARENT ELECTRODE AND A DIELECTRIC LAYER AND A METHOD OF MAKING THE SAME

[75] Inventors: Takeo Matsudaira; Yasumoto Shimizu, both of Tokyo, Japan

[73] Assignee: Hoya Corporation, Tokyo, Japan

[21] Appl. No.: 824,071

[22] Filed: Jan. 30, 1986

[30] Foreign Application Priority Data

Jan. 31, 1985 [JP] Japan ..... 60-15447

[51] Int. Cl.[4] ..... H05B 33/22; H05B 33/02

[52] U.S. Cl. ..... 313/509; 313/498

[58] Field of Search ..... 313/506, 509, 503, 502, 313/498

[56] References Cited

U.S. PATENT DOCUMENTS

| | | | |
|---|---|---|---|
| 3,274,024 | 9/1966 | Hill et al. | 313/509 X |
| 3,854,070 | 12/1974 | Vlasenko et al. | 313/509 X |
| 4,188,565 | 2/1980 | Mizukami et al. | 313/509 |
| 4,594,282 | 6/1986 | Kawaguchi et al. | 313/509 X |

*Primary Examiner*—David K. Moore
*Assistant Examiner*—K. Wieder
*Attorney, Agent, or Firm*—Roberts, Spiecens & Cohen

[57] ABSTRACT

In an electroluminescent panel comprising a transparent electrode, a back electrode, an electroluminescent layer between the transparent and the back electrodes, and a dielectric layer between the transparent electrode and the electroluminescent layer, an intermediate layer consisting of silicon is interposed between the transparent electrode and the dielectric layer. The silicon layer may have a thickness between 10 angstroms and 200 angstroms. The silicon layer may be deposited on the transparent electrode by the use of a selected one of sputtering, vacuum evaporation, chemical vapor deposition, and ion plating techniques.

6 Claims, 1 Drawing Figure

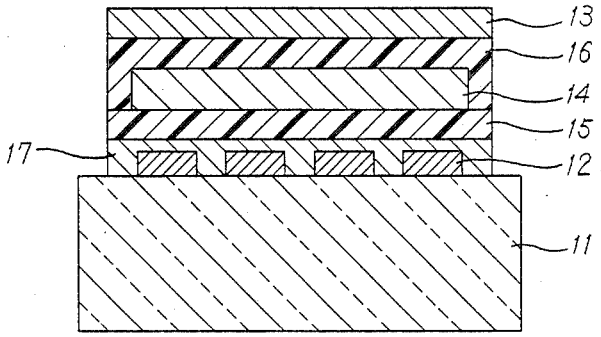
13
16
14
15
17
12
11

ELECTROLUMINESCENT PANEL COMPRISING A LAYER OF SILICON BETWEEN A TRANSPARENT ELECTRODE AND A DIELECTRIC LAYER AND A METHOD OF MAKING THE SAME

BACKGROUND OF THE INVENTION (a) Field of the Invention

This invention relates to an electroluminescent panel for use in an input/output device of a computer or the like to display an image, such as alphanumeric symbols, a static picture, a motion picture, and the like and to a method of manufacturing the electroluminescent panel.

(b) Description of Prior Art

A conventional electroluminescent panel of the type described comprises a transparent substrate, a transparent electrode on the substrate, a back electrode opposite to the transparent electrode, and an electroluminescent layer placed between the transparent and the back electrodes. In addition, a dielectric layer is usually interposed between the transparent electrode and the electroluminescent layer.

With this structure, electroluminescent light is emitted from the electroluminescent layer and can be seen through the transparent substrate in a well-known manner when an a.c. voltage is supplied between the transparent and the back electrodes.

The dielectric layer is useful for raising a breakdown voltage of the electroluminescent panel.

In order to raise the breakdown voltage, it is preferable that the dielectric layer has a high dielectric strength, a high relative dielectric constant, and a low dielectric loss.

Heretofore, various oxides are used as materials of the dielectric layer. Such oxides are, for example, yttrium oxide ($Y_2O_3$), tantalum pentoxide ($Ta_2O_5$), aluminum oxide ($Al_2O_3$), zirconium oxide ($ZrO_2$), hafnium oxide ($HfO_2$), lead titanate ($PbTiO_3$), and barium tantalate ($BaTa_2O_6$).

On manufacturing an electroluminescent panel of the above-mentioned type, the dielectric layer is generally formed on the transparent electrode by the use of a sputtering technique in order to prevent occurrence of fine defects. Then, the electroluminescent layer is formed on the dielectric layer and is subjected to a heat treatment at a temperature between 400° C. and 600° C. so as to activate the electroluminescent layer.

It has been found that the above-mentioned transparent electrode is likely to be blackened and to thereby increase an electric resistance thereof when the dielectric layer is manufactured in the manner mentioned above. Such a blackened transparent electrode results in a reduction of brightness of the electroluminescent panel. Such an increased electric resistance of the transparent electrode brings out increasing power consumption in the electroluminescent panel and also degrading panel quality. Such degradation of panel quality results from unevenness of the brightness due to variation of the electric resistance.

Alternatively, a layer of silicon nitride ($Si_3N_4$) is often deposited as the dielectric layer on the transparent electrode in a non-oxygen atmosphere. It has been confirmed that deposition of silicon nitride is effective to protect the transparent electrode from being blackened. However, the dielectric layer of $Si_3N_4$ is very weak in adhesion to the transparent electrode. Therefore, peeling off often occurs between the transparent electrode and the dielectric layer of $Si_3N_4$ when the electroluminescent layer is subjected to the heat treatment. Such detachment rarely occurs even when the dielectric layer is of the oxide.

An improved electroluminescent panel is disclosed in Japanese Unexamined Patent Publication No. Syô 52-33491, namely, 33491 of 1977. The electroluminescent panel comprises an intermediate layer consisting of silicon dioxide ($SiO_2$) between the transparent electrode and the dielectric layer of $Si_3N_4$. The intermediate layer of $SiO_2$ is formed on the transparent electrode by the use of sputtering so as to increase adhesion between the transparent electrode and the dielectric layer of $Si_3N_4$. However, the electroluminescent panel is defective in that the transparent electrode is prone to be blackened and to thereby increase an electric resistance thereof during manufacturing the electroluminescent panel. Thus, a reduction of the brightness and an increase of power consumption are inevitable in the above-mentioned electroluminescent panel.

Another improved electroluminescent panel is disclosed by Etsuo Mizukami et al in U.S. Pat. No. 4,188,565. The electroluminescent panel comprises dielectric layer of silicon-oxynitride between the transparent electrode and the electroluminescent layer. The dielectric layer of silicon-oxynitride is deposited on the transparent electrode by the use of sputtering. The sputtering is carried out by the use of a target of silicon in the presence of oxygen in addition to nitrogen. The dielectric layer of silicon-oxynitride may bring about a good adhesion to the electroluminescent layer. However, the dielectric layer of silicon-oxynitride may be poor in adhesion to the transparent electrode. In addition, a reduction of brightness and an increase of power consumption are unescapable even by depositing the dielectric layer of silicon-oxynitride. Therefore, adhesion of the transparent electrode to the dielectric layer of silicon-oxynitride is not always sufficient to avoid detachment of the transparent electrode from the dielectric layer.

SUMMARY OF THE INVENTION

It is therefore an object of this invention to provide an electroluminescent panel which has excellent characteristics.

It is another object of this invention to provide an electroluminescent panel of the type described, which has a strong adhesion between a dielectric layer and a transparent electrode, without blackening of the transparent electrode.

It is still another object of this invention to provide an electroluminescent panel of the type described, which has a good brightness and a low power consumption.

An electroluminescent panel to which this invention is applicable comprises a transparent electrode, a back electrode opposite to the transparent electrode, an electroluminescent layer for emitting electroluminescent light between the transparent and the back electrodes, and a dielectric layer between the transparent electrode and the electroluminescent layer. According to this invention, the electroluminescent panel comprises an intermediate layer between the transparent electrode and the dielectric layer. The intermediate layer consists of silicon.

BRIEF DESCRIPTION OF THE DRAWING

The sole FIGURE of the drawing is a sectional view of an electroluminescent panel according to an embodiment of this invention.

DESCRIPTION OF THE PREFERRED EMBODIMENT

Referring to the FIGURE of the drawing, an electroluminescent panel according to an embodiment of this invention comprises a transparent substrate 11 of aluminosilicate glass which comprises $Al_2O_3$ and $SiO_2$ and which may be, for example, NA40 manufactured and sold by HOYA Corporation, Tokyo, Japan. The substrate 11 has a principal surface which is directed upwards of this FIGURE and on which a transparent electrode 12 is deposited. The illustrated transparent electrode 12 consists of a plurality of transparent conductors of indium oxide ($In_2O_3$) doped with tin oxide ($SnO_2$). Each of the transparent conductors is electrically isolated from one another with a spacing left between two adjacent ones of the transparent conductors and is extended from a front side of this FIGURE to a back side thereof. The spacing may be, for example, 50 micrometers wide.

A back electrode 13 is opposite to the transparent electrode 12 and consists of a plurality of back conductors of, for example, aluminum. The back conductors are orthogonal to and isolated from the transparent conductors.

An electroluminescent layer 14 is interposed between the transparent and the back electrodes 12 and 13. The illustrated electroluminescent layer 14 comprises zinc sulfide (ZnS) and manganese (Mn). The zinc sulfide (ZnS) and the manganese (Mn) serve as a base material and an activator, respectively, when electroluminescent light is emitted from the electroluminescent layer 14. The electroluminescent layer 14 is deposited in the manner to be described later.

A first dielectric layer 15 is interposed between the transparent electrode 12 and the electroluminescent layer 14 while a second dielectric layer 16 is laid between the electroluminescent layer 14 and the back electrode 13. The second dielectric layer 16 covers both ends of the electroluminescent layer 14, as illustrated in this FIGURE. Each of the first and the second dielectric layers 15 and 16 may be of tantalum pentoxide ($Ta_2O_5$) and is deposited in a manner which will be also described later.

An intermediate layer 17 underlies the first dielectric layer 15 with the transparent electrode 12 covered with the intermediate layer 17. More particularly, the intermediate layer 17 is laid between the transparent electrode 12 and the first dielectric layer 15 and is in close contact with the transparent electrode 12. The intermediate layer 17 is also partially deposited through the spacing between two adjacent transparent electrodes 12 and is partially brought into contact with the transparent substrate 11. The intermediate layer 17 consists of silicon and will be called a silicon layer. The silicon layer 17 is formed in a manner which will be also described later.

With this structure, electroluminescent light is emitted from the electroluminescent layer 14 when an a.c. voltage is supplied between the transparent and the back electrodes 12 and 13. The electroluminescent light is visible through the first dielectric layer 15, the silicon layer 17, the transparent electrode 12, and the transparent substrate 11.

On manufacturing the illustrated electroluminescent panel, a transparent conductive layer for the transparent electrode 12 is formed on the transparent substrate 11 by the use of a sputtering technique and is etched into the transparent electrode 12 in the manner known in the art. The transparent electrode 12 may be, for example, 2000 angstroms thick.

On the transparent electrode 12 and the transparent substrate 11, the silicon layer 17 is deposited by the use of sputtering in an atmosphere of an inactive gas, such as argon gas. Thus, no oxygen gas is present in the atmosphere. That is, the silicon layer 17 is formed in a substantially nonoxidizable atmosphere wherein a partial pressure of oxygen gas is not higher than 1% of a total pressure of a remnant gas. The silicon layer 17 has a thickness of 50 angstroms on the transparent electrode 12. The sputtering is carried out by the use of a target of silicon in an atmosphere of argon gas kept at a pressure of $7\times10^{-1}$ pascal. In addition, the substrate 11 is kept at 200° C. during the sputtering.

It has been found out that the transparent electrode 12 is never blackened during deposition of the silicon layer 17. This is because the transparent electrode 12 is not exposed to oxygen gas during the sputtering.

On the silicon layer 17, the first dielectric layer 15 of $Ta_2O_5$ is deposited to a thickness of, for example, 4000 angstroms by the use of sputtering. The sputtering is carried out by the use of a target consisting of $Ta_2O_5$ in an atmosphere of argon gas and oxygen gas.

Thus, oxygen ions inevitably appear in the atmosphere on deposition of the first dielectric layer 15. However, the transparent electrode 12 is not blackened because it is covered with the silicon layer 17 and is prevented from being oxidized. It is therefore possible to keep the resistance of the transparent electrode 12 unchanged during deposition of the first dielectric layer 15.

Thereafter, the first dielectric layer 15 is covered with the electroluminescent layer 14 by vacuum evaporation or deposition. In this event, provision is made of an evaporation source which comprises zinc sulfide doped with 0.5% by weight of manganese. The evaporation lasts by the use of the evaporation source until the electroluminescent layer 14 reaches a thickness of 6000 angstroms. Subsequently, the electroluminescent layer 14 is subjected to a heat or annealing treatment at a temperature between 400° C. and 500° C. in a nonoxidizable vacuum atmosphere.

Thereafter, the second dielectric layer 16 of $Ta_2O_5$ is formed on the electroluminescent layer 14 by the use of sputtering like the first dielectric layer 15. The second dielectric layer 16 is deposited to a thickness of 4000 angstroms.

Thereafter, an aluminum layer is deposited on the second dielectric layer 16 by the use of vacuum evaporation and is etched into the back electrode 13 in a manner known in the art. The back electrode 13 may be of an alloy of aluminum and nickel. Thus, the illustrated electroluminescent panel is finally manufactured through the above-mentioned processes.

It is to be noted here that the silicon layer 17 is deposited on the transparent layer 12 in the absence of oxygen and serves to protect the transparent layer 12 from being blackened. Accordingly, it is possible to avoid a reduction of brightness and an increase of power consumption. This means that a non-oxidized layer serves to protect blackening of the transparent electrode 12.

Moreover, it has been confirmed that no detachment or peeling off occurs between the transparent electrode 12 and the first dielectric layer 15 and between the transparent substrate 11 and the first dielectric layer 15 when the electroluminescent layer 14 is subjected to the heat treatment. From this viewpoint, it can be understood that presence of the silicon layer 17 is extremely effective to prevent detachment between the transparent electrode 12 and the first dielectric layer 15 and between the transparent substrate 11 and the first dielectric layer 15.

Description will now be regarding the value obtained by the silicon layer 17. As mentioned before, the transparent electrode 12 is made of an oxide, such as indium oxide ($In_2O_3$) or stannic oxide ($SnO_2$) and therefore includes oxygen ions. The transparent substrate 11 also includes oxygen ions because the transparent substrate 11 is also made of oxide, such as aluminum oxide ($Al_2O_3$) or silicon dioxide ($SiO_2$) as described above. On the other hand, the silicon layer 17 is firmly adhered to the transparent electrode 12 and the transparent substrate 11, on deposition of the silicon layer 17. This means that the oxygen ions and silicon ions included in the silicon layer 17 are bonded to one another by partially forming an ionic bond in interfaces between the silicon layer 17 and the transparent electrode 12 and between the silicon layer 17 and the transparent substrate 11. Such ionic bond might give rise to a strong adhesion between the silicon layer 17 and the transparent electrode 12 and between the silicon layer 17 and the transparent substrate 11.

Oxygen ions are also present in the first dielectric layer 15 of oxide, such as tantalum pentoxide ($Ta_2O_5$). On deposition of the first dielectric layer 15, the oxygen ions in the first dielectric layer 15 are also firmly bonded to the silicon ions by forming an ionic bond in an interface between the first dielectric layer 15 and the silicon layer 17. The ionic bond also serves to provide a strong adhesion between the first dielectric layer 15 and the silicon layer 17.

In the illustrated electroluminescent panel, the silicon layer 17 is firmly and strongly bonded to the dielectric layer 15, the transparent electrode 12, and the transparent substrate 11. A strong adhesion is accomplished between the dielectric layer 15 and the silicon layer 17, between the transparent electrode 12 and the silicon layer 17, and between the transparent substrate 11 and the silicon layer 17. It is therefore possible to protect the peeling off between the first dielectric layer 15 and the transparent electrode 12 and between the first dielectric layer 15 and the transparent substrate 11 when the electroluminescent layer 14 is subjected to the heat treatment or annealing.

Protection of detachment as mentioned above can not be accomplished when a layer of either silicon dioxide ($SiO_2$) or silicon-oxynitride is disposed between a transparent electrode of oxide and an electroluminescent layer and is in contact with the transparent electrode as described in the preamble of the instant specification. This is because not only silicon ions but also oxygen ions are included in the layer of silicon dioxide or silicon-oxynitride and have already been bonded to one another. As a result, no ionic bonds can newly be formed between the above-mentioned silicon ions and oxygen ions included in the transparent electrode and the dielectric layer.

Preferably, the thickness of the silicon layer 17 is equal to or thicker than 10 angstroms in order to prevent the burning or blackening of the transparent electrode 12 and the peeling off between the transparent electrode 12 and the first dielectric layer 15. It is also desirable that the thickness of the silicon layer 17 is not greater than 200 angstroms in view of avoiding a reduction of transparency, as will be described below. Inasmuch as the silicon layer 17 has a light absorption property in an optical region of a visible light, a part of the electroluminescent light emitted from the electroluminescent layer 14 is absorbed by the silicon layer 17 and only the remaining part of the electroluminescent light is passed through the transparent electrode 12 and the transparent substrate 11 as an output light of the electroluminescent panel. When the thickness of the silicon layer 17 is not greater than 200 angstroms as described above, light absorption of the silicon layer 17 may be substantially negligible and does not adversely influence the brightness of the output light.

Consideration will be made about a relationship between the silicon layer 17 and an electric characteristic of the electroluminescent panel. A threshold value is determined which make an electroluminescent panel luminesce. It is confirmed that the electroluminescent panel according to this invention has a threshold value substantially equal to that of a conventional electroluminescent panel which comprises no silicon layer between a first dielectric layer and a transparent electrode. In addition, the silicon layer 17 is brought into contact with the transparent electrode 12 and has a thin thickness on the transparent electrode 12, as mentioned before. Under the circumstances, it can be considered that the silicon layer 17 acts as a part of the transparent electrode 12 rather than a dielectric layer on the transparent electrode 12 on the one hand. On the other hand, the spacing between two adjacent conductors of the transparent electrode 12 is not usually less than 50 microns and is extremely greater than the thickness of the transparent electrode 12. Therefore, the silicon layer 17 may be considered as an insulator in the spacing. Therefore, any crosstalk does not occur such that an undesired picture element is objectionably luminous at an undesired position adjacent to a desired position. Thus, the silicon layer 17 has no influence on an electric characteristic for the electroluminescent panel.

While the present invention has thus far been described in conjunction with a preferred embodiment thereof, it will now readily be possible for those skilled in the art to put this invention into practice in various other manners. For example, each of the first and the second dielectric layers may be of an oxide selected from a group of yttrium oxide ($Y_2O_3$), aluminum oxide ($Al_2O_3$), barium tantalate ($BaTa_2O_6$), lead titanate ($PbTiO_3$), zirconium oxide ($ZrO_2$), and hafnium oxide ($HfO_2$). Each of the first and the second dielectric layers may also be of silicon-oxynitride or silicon nitride ($Si_3N_4$) When the first dielectric layer is of the silicon nitride ($Si_3N_4$), the above-mentioned ionic bonds among oxygen ions and silicon ions are not formed between the first dielectric layer and a silicon layer underlying the first dielectric layer because the first dielectric layer comprises no oxygen ion. It is, however, confirmed that a strong adhesion is obtained between the silicon layer and the first dielectric layer of $Si_3N_4$ like in the electroluminescent panel illustrated in FIGURE. Each of the first and the second dielectric layers may be divided into a plurality of partial dielectric layers of different dielectric materials. The silicon layer 17 may be formed by the use of a selected one of vacuum evaporation, chemical vapor deposition, and ion plating techniques. The transparent electrode 12 may be of an oxide selected from a group of indium oxide ($In_2O_3$), stannic oxide ($SnO_2$), and the like. A light absorption layer may be interposed between the electroluminescent layer 14 and the second dielectric layer 16 or between the second dielectric layer 16 and the back electrode 13 in order to absorb ambient light. Alternatively, the back electrode 13 may be either an electrode of a black color or a combination of an electrode and a black background plate attached to the electrode. Not only the light absorption layer but also another layer of silicon may be interposed between the electroluminescent layer 14 and the second dielectric layer 16 and/or between the second dielectric layer 16 and the back electrode 13. An additional layer of silicon may be interposed between the first dielectric layer 15 and the electroluminescent layer 14 or between the electroluminescent layer 14 and the second dielectric layer 16. As regards the electroluminescent layer 15, the activator may be selected from a group of terbium fluoride ($TeF_3$), samarium fluoride ($SmF_3$), praseodymium fluoride ($PrF_3$), dysprosium fluoride ($DyF_3$), and the like. The base material may be selected from a group of zinc selenide (ZnSe), calcium sulfide (CaS), strontium sulfide (SrS), barium sulfide (BaS), and the like. Finally, the transparent substrate 11 may be of heat resistant plastic.

What is claimed is:

1. In an electroluminescent panel comprising a transparent electrode, an intermediate layer in contact with said transparent electrode, a dielectric layer in contact with said intermediate layer, an electroluminescent layer on said dielectric layer, and a back electrode overlying said electroluminescent layer, the improvement wherein said intermediate layer consists of silicon without any silicon oxide.

2. An electroluminescent panel as claimed in claim 1, wherein said intermediate layer has a thickness which is not less than 10 angstroms.

3. An electroluminescent panel as claimed in claim 1, wherein said intermediate layer has a thickness between 10 angstroms and 200 angstroms, both inclusive.

4. An electroluminescent panel as claimed in claim 1, wherein said intermediate layer is manufactured by a process selected from the group consisting of sputtering, vacuum evaporation, chemical vapor deposition, and ion plating techniques.

5. An electroluminescent panel as claimed in claim 1, wherein said dielectric layer is of an oxide selected from the group consisting of tantalum pentoxide, yttrium oxide, aluminum oxide, barium tantalate, lead titanate, zirconium oxide, and hafnium oxide.

6. An electroluminescent panel as claimed in claim 1, wherein said transparent electrode is of an oxide selected from the group consisting of indium oxide, stannic oxide, and a combination of indium oxide and stannic oxide.

* * * * *